United States Patent [19]

Davis

[11] Patent Number: 5,026,061

[45] Date of Patent: Jun. 25, 1991

[54] GOLF PRACTICE FLAG ASSEMBLY AND BALL RETRIEVER HOLDER THEREFOR

[76] Inventor: Dana B. Davis, 1805 E. Marks St., Orlando, Fla. 32803

[21] Appl. No.: 543,265

[22] Filed: Jun. 25, 1990

[51] Int. Cl.[5] ..... A63B 69/36; A63B 47/02; G09F 17/00

[52] U.S. Cl. ..... 273/177 R; 116/173; 224/919; 294/19.2; 273/34 R

[58] Field of Search ..... 273/177 R, 32 R, 32 B, 273/32 D, 32 F, 34 R, 34 A, 34 B; 116/173, 174, 175; 224/919; 294/19.2

[56] References Cited

U.S. PATENT DOCUMENTS

| | | | |
|---|---|---|---|
| 443,124 | 7/1890 | Hall | 116/173 |
| 2,024,484 | 12/1935 | Smith | 150/1.5 |
| 2,203,170 | 6/1940 | MacDonald | 294/19 |
| 3,117,814 | 1/1964 | Webb | 294/19 |
| 3,195,898 | 1/1965 | Respini | 273/181 |
| 4,194,779 | 3/1980 | Ouhashi | 294/19 |
| 4,407,505 | 10/1983 | Kendziorski | 273/177 |
| 4,541,119 | 9/1985 | Cooper et al. | 455/57 |
| 4,643,317 | 2/1987 | Wilkinson et al. | 211/14 |
| 4,691,922 | 9/1987 | Peel et al. | 273/177 |

*Primary Examiner*—George J. Marlo
*Attorney, Agent, or Firm*—Warren L. Franz

[57] ABSTRACT

A portable segmented flagstaff for a golf practice flag has a main coaxial prong and a parallel, laterally offset secondary prong joined by a horizontal crosspiece with a flat upper surface which serves to anchor the flag by foot and limit prong ground penetration. A handled, hollow tube ball retriever has laterally extending, upper and lower bracket members that form a holder for the separated flagstaff segments. Lower pointed ends of the segments are received in recesses of the lower member, and shaft portions are received within resiliently yieldable, opposing fingers of the upper member.

11 Claims, 2 Drawing Sheets

GOLF PRACTICE FLAG ASSEMBLY AND BALL RETRIEVER HOLDER THEREFOR

This invention relates in general to a portable golf practice flag assembly and to a carrier usable therewith; and, in particular, relates to a flag assembly having a dual-pronged, segmented flagstaff and to a handled ball retriever holder for carrying the broken down flagstaff.

BACKGROUND OF THE INVENTION

To give a true golf course feeling, it is desirable to use a golf flag for stroke practice in the game of golf, especially to serve as a target for driving or "shagging" golf balls. It is also desirable in connection with golf ball driving practice to have means available for retrieving the spent balls, without the need to stoop over and pick them up by hand.

Full size, regulation golf flag assemblies are cumbersome for golfers to carry and difficult to properly set in the ground. They come with a cup support which is not needed for driving practice without holes. Golf flag assemblies have been proposed which are readily portable and which do not require a cup for support. Examples of such devices having a single coaxially depending spike for setting the flagstaff are shown in U.S. Pat. Nos. 4,407,505 and 4,691,922. The spike is embedded in the ground by gripping the staff by hand and forcing it downward. This is an awkward maneuver and one that frequently results in the staff being driven in at an angle, or being anchored too loosely.

Various conventional devices exist for retrieving golf balls. Examples of such ball retrievers are shown in U.S. Pat. Nos. 2,203,170; 3,117,814; and 4,194,779. A typical arrangement, shown in the '170 patent, includes a hollow vertical tube having a lower opening for receiving and capturing the balls, and an upper opening for discharging them into a container, such as a sack or bag, surrounding the tube at the upper opening. Self-closing valve means, such as a plurality of resiliently yieldable, confronting fingers disposed at the lower opening, serves to prevent the escape of the balls once admitted. A handle is rigidly connected at the upper end of the tube to serve as a grip to carry and manipulate the retriever. In operation, the lower opening of the tube is pressed down on a ball, activating the valve means to pass the ball into the tube. Then, under action of subsequently retrieved balls, each ball is passed up the tube to the upper opening and over into the container. The ball retriever is a useful article, welcome at driving practice. But it is inconvenient to separately carry a practice flag assembly, a number of clubs and a ball retriever, all at once.

SUMMARY OF THE INVENTION

It is an object of the present invention to provide a golf practice device in the form of a break-down golf flag assembly usable without a cup and including means for facilitating its setting into an upright position in the ground.

It is a further object of the invention to provide a golf practice device in the form of a combination break-down golf practice flag assembly and a ball retriever holder therefor, so that the broken down flag assembly components may be conveniently transported, together with the ball retriever, to and from a practice site.

In one aspect of the invention, a golf practice flag assembly with a segmented flagstaff has a coaxially depending tapered main prong and a parallel depending similar secondary prong, laterally offset by a horizontal crosspiece from the main prong. In a preferred embodiment, the crosspiece has a flat upper surface extending the width of a foot that provides a foothold to assist in burial of the prongs. The crosspiece acts with the prongs to limit depth of insertion and to ensure uprightness and stability of the erected flagstaff.

In another aspect of the invention, a golf practice device includes a portable, segmented flagstaff as described, together with a holder built around a ball retriever for carrying the separated flagstaff segments. An upper bracket member secured to the ball retriever handle includes laterally spaced clamping means for releasably retaining respective upper shaft portions of the staff segments. A lower bracket member secured to the lower end above a ball receiving opening of a hollow tube of the retriever includes laterally spaced bores or recesses into which the pointed ends of the segments are placed. An elongated bracing member extending parallel to the retriever helps define the vertical spacing between the bracket members and adds rigidity to the holder.

BRIEF DESCRIPTION OF THE DRAWINGS

Embodiments of the invention have been chosen for purposes of description and illustration, and are shown in the accompanying drawings, wherein.

Throughout the drawings, like elements are referred to by like numerals.

DESCRIPTION OF PREFERRED EMBODIMENTS

Figure 1:
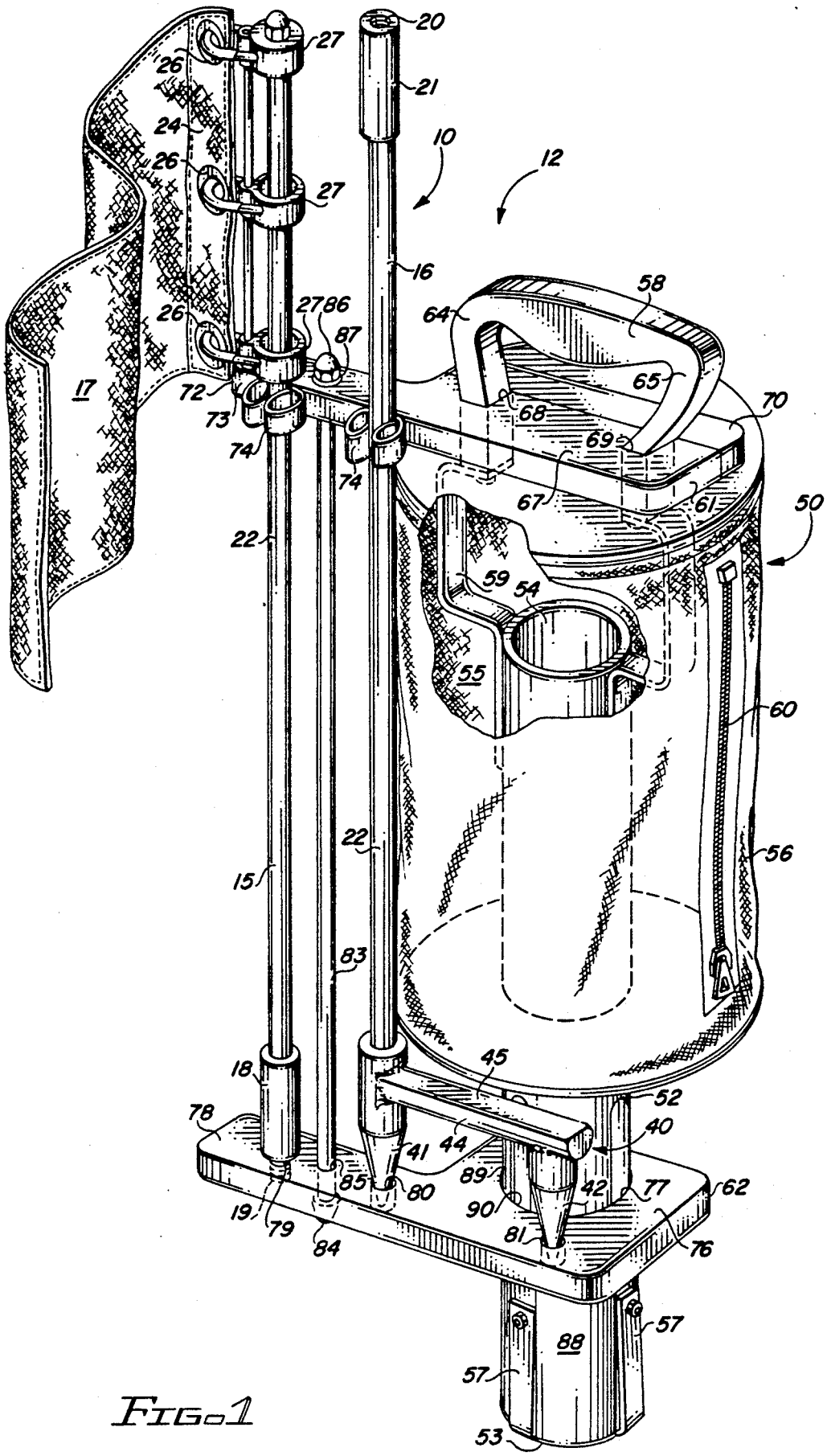
FIG. 1 is a perspective view, with portions cut away, of a preferred embodiment of a flag assembly and ball retriever holder for carrying the broken down components of the same.

The principles of the invention are described by way of example in their application to a golf practice flag assembly 10 shown in FIGS. 1 (broken down) and 2 (assembled), and to a holder 12, shown in FIG. 1 for carrying the same.

The assembly 10 comprises a generally vertical flagstaff 14 made up of upper and lower vertically elongated segments 15, 16 which may be detachably connected in coaxial alignment (FIG. 2) to support a flag 17 at its upper end. The staff 14 may optionally include additional segments (not shown) intermediate the segments 15, 16.

Detachable connection between the segments 15, 16 is provided by means, such as tip member 18 having a reduced diameter, externally threaded shank part 19 (FIG. 1) that may be selectively interengaged with an internally threaded bore 20 of an opposing tip member 21. Tip member 18 may be fixed coaxially onto the lower end of the shaft segment 15 and tip member 21 may be fixed coaxially onto the upper end of the shaft segment 16, or vice versa. The main portion 22 of each segment 15, 16 may be a fiberglass circular rod of uniform diameter, and the tip members 18, 21 may be tubular metallic elements formed with bores into which the respective ends of the rods are secured.

The flag 17 may be a conventional rectangular golf flag with a reinforced edge 24 of woven material and having a plurality of vertically spaced grommets 26 which cooperate with suitable connecting means to join the flag 17 to the staff 14. The shown means comprises a plurality of tubular sections or sleeves 27 having central bores 28 coaxially received in vertically spaced positions about the main shaft portion 22 of segment 15. Each section 27 also includes a generally horizontally extending loop portion 29 formed integrally therewith and which is split at 30 for the purpose of passing each loop portion 29 through a respective one of grommets 26.

The bores 28 are sized relative to the shaft portion 22 to enable free rotation of the sections 27 about the axis of segment 15 and, except for an uppermost one 27a (FIG. 2) of the sections 27, the sections 27 are likewise free to also enable movement axially of the shaft portion 22 of segment 15. The bore of top section 27a has a reduced diameter at its top end which cooperates with a reduced diameter, stepped upper end tip member 31 at the top of segment 15 to prevent downward axial movement of the upper section 27a. Upward movement of the section 27a is prevented by a removable threaded nut 32 that meshes with an externally threaded, upwardly projecting, reduced diameter portion (not shown) of the tip member 31. The sections 27 are further provided with side channels 33 located within the loop portions 29 and having vertically aligned secondary bores 34 therethrough. A length of rod 35 having enlarged upper and lower extremities 36, 37 passes through the bores 34 to limit the extent of rotation and amount of vertical spacing of the sections 27 relative to one another. The number of sections 27 matches the number of grommets 26.

Figure 2:
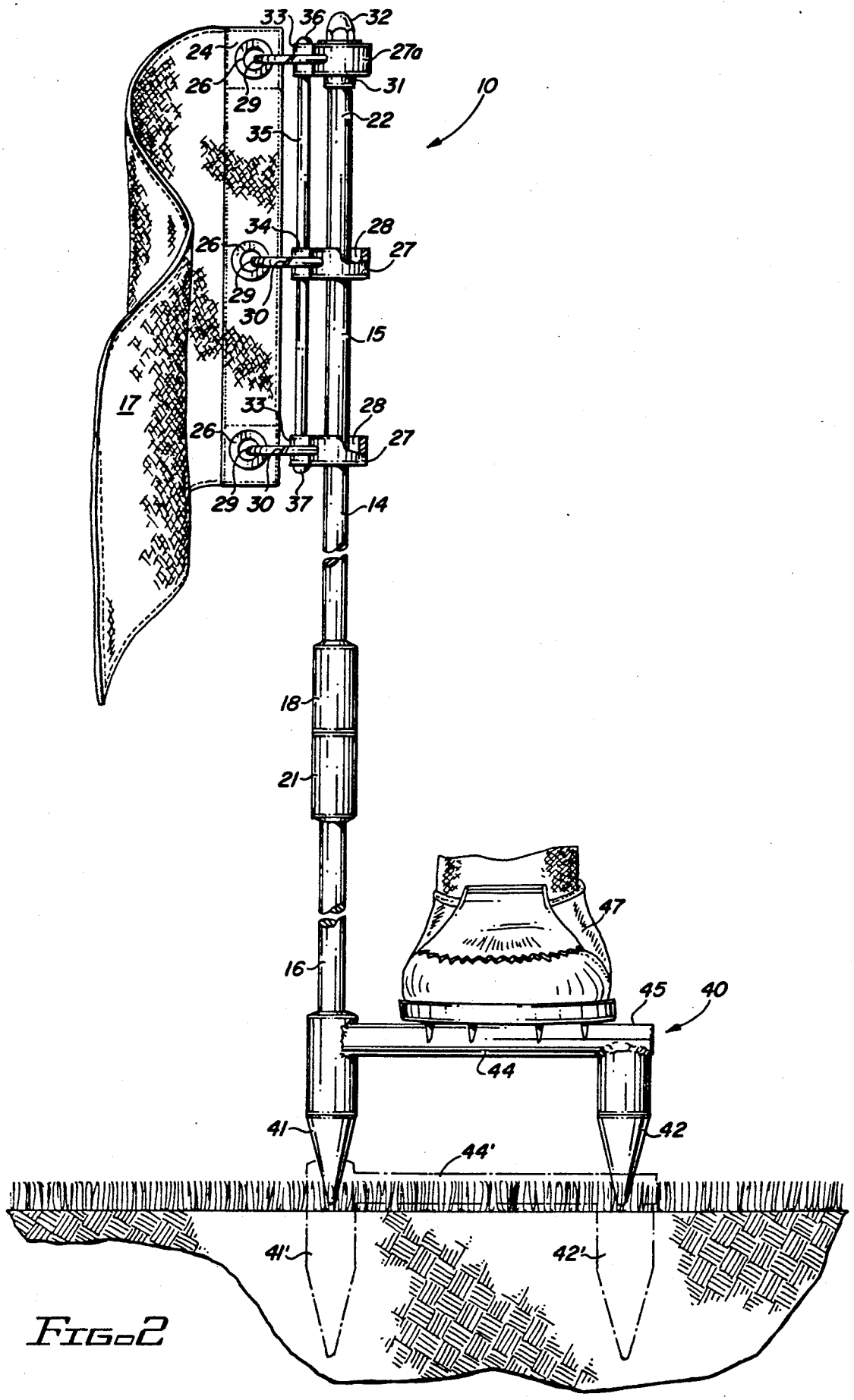
FIG. 2 is a front view of the assembled flag assembly of FIG. 1, separated from the holder, and shown being deployed for driving practice.

As an important feature of the invention, the bottom of the flag assembly 10 is furnished with a dual-pronged ground stake element 40. The element 40 may be formed as an integral tip component for attachment as with tip members 18, 21, 31 to the lower end of segment 16. Stake 40 includes a tapered main prong 41 which depends coaxially from the lower end of segment 16, and also a tapered secondary prong 42 which depends in like fashion laterally spaced from prong 41 and parallel thereto, as shown. A generally horizontally extending elongated crosspiece 44 joins upper parts of the prongs 41, 42 and includes a flat upper surface 45 that has an elongation of sufficient dimension to accommodate the width of a shoe 47 (see FIG. 2). The parallel prongs 41, 42 have downwardly facing points adapted for insertion into the ground. The crosspiece 44 is configured and adapted to provide a foothold to assist such insertion and also to act as a stop to limit the depth to which the prongs can penetrate the ground. The flag assembly is erected by pushing down with the foot 47 on the crosspiece to move it from the solid line position 44 to the dot-dash position 44', as indicated in FIG. 2.

Details of the holder 12 for carrying the broken down segments 15, 16 of the flag assembly 10 are shown in FIG. 1. The holder 12 is built around a ball retriever 50 which may, for example, take the form of a conventional retriever similar to that shown in U.S. Pat. No. 2,203,170, the disclosure of which is incorporated herein by reference.

The retriever 50, as with the similar structure shown in the '170 patent, includes a vertically elongated hollow tube 52 having a lower opening 53 for receiving balls and an upper opening 54 for discharging them into an internal cavity 55 of a chamber formed by a flexible bag or a like container 56 that surrounds the tube 52 in the vicinity of upper opening 54 to provide a repository for receiving and storing balls discharged from the tube 52. The lower end of the tube 52 includes self-closing valve means, such as resiliently yieldable fingers 57 that extend into the opening 53, for preventing the escape of received balls. An inverted U-shaped handle 58, fixed above the upper opening 54 by a frame 59, secures the top of the container 56 to the tube 52 and provides a grip for carrying and manipulating the retriever 50. The container 56 may be made free-hanging and is provided with a selectively openable closure 60 so that its bottom may be lifted for releasing captured balls through the opened closure 60.

In accordance with the invention, upper and lower bracket members 61, 62 are provided to extend in respective fixed, generally horizontal relationships to the handle 58 and the tube 52. The members 61, 62 are outfitted to enable storage for convenient carrying by handle 58 of the broken down segments 15, 16, with their shaft portions 22 side-by-side and parallel to the ball retriever 50.

The shown upper bracket member 61 has a split construction for surrounding upwardly projecting arm portions 64, 65 of the handle 58. A front piece 67 of member 61 has cutouts 68, 69 that respectively match the contours of the portions 64, 65 and into which those portions are received. A back piece 70 of member 61 is brought into abutment over the cutouts 68, 69 of the piece 67 to retain the arm portions 64, 65 within the cutouts 68, 69. The front piece 67 also includes a lateral extension 72 having a front surface 73 on which are located clamping means in the form of laterally-spaced pairs of resiliently yieldable, opposing fingers 74 adapted to releasably receive and secure respective portions 22 of the separated segments 15, 16.

The shown lower bracket member 62 is also of generally horizontal planar configuration. It includes an enlarged platform portion 76 having a vertical bore 77 through which the tube 52 of the retriever 50 extends. The member 62 also includes a lateral extension 78 in general alignment with extension 72 of member 61. Extension 78 has an upper surface including three recesses in the form of vertical bores 79, 80, 81, dimensioned and relatively positioned with respect to each other and to the clamps 74 of member 61, so that the threaded shank 19 of tip 18 can extend down into recess 79, and the respective points of prongs 41, 42 of stake 40 can extend into recesses 80, 81 when the shaft portions 22 of segments 15, 16 are clamped onto member 61.

Relative vertical spacing of the bracket members 61, 62 is achieved by attachment of member 61 to handle 58, attachment of member 62 to tube 52, and by additional bracing means, such as a metallic rod 83, extending vertically between respective points of attachment on members 61, 62, laterally spaced from ball retriever 50. The shown rod 83 has an enlarged head end 84 that acts as a stop to upward movement of the rod 83 through a vertical bore 85 located intermediate the bores 79,80 in extension 78, and an externally threaded upper end that is brought up through an aligned bore 87 in extension 72 and mated with a nut 86.

The bracket members 61, 62 can be suitably constructed of Lucite or similar rigid plastic material. The lower end of tube 52 can be secured at the portion 76 of member 62 by passing it down through the bore 77 before attachment of an enlarged terminal sleeve 88 that holds the fingers 57. A key 89 can be provided on the tube 52 to match with a keyway 90 formed in the bore 77 in order to prevent relative rotation of the tube 52 and the member 62. The vertical spacing of the upper and lower bracket members 61, 62 is preferably less than the vertical heights of the segments 15, 16, so that the upper ends of the separated segments 61, 62 (including a major portion of the flag edge 24) extend above the top of the bracket member 61.

In operation, the segments 15, 16 of the flagstaff 14 are mated together by threading the shank part 19 of the tip member 18 into the bore 20 of the tip member 21 (FIG. 1) in order to coaxially join segments 15, 16 to form the vertical height of the flagstaff 14 (FIG. 2). The staff 14 may then be easily anchored in a stable, substantially upright position by stepping on the crosspiece 44 to sink the prongs 41, 42 from their solid line positions 41, 42, to their buried dot-dash positions 41', 42', as indicated in FIG. 2. The prongs 41, 42 will descend until the bottom of the crosspiece 45 assumes the ground contacting dot-dash position 45'.

When the flag assembly 10 is deployed, the ball retriever 50 can be used in its normal manner, without interference by the bracket members 61, 62. After the assembly 10 has been broken down into its separate segments 15, 16, it can be conveniently stored on the holder 12, so that the combination can be carried as a unit using the retriever handle 58. Segment 15 is deposited in the holder 12 by angling the same and placing the reduced diameter lower end 19 into the recess 79. The segment 15 is then restored to a vertical position, with the portion 22 being engaged by pushing it rearwardly between the pair of confronting fingers 74 aligned above the recess 79. The sections 27 connecting the flag 17 can be slid axially up on the shaft 22, to avoid interference with the clamping means. In like fashion, segment 16 is angled and its prongs 41, 42 placed in the respective recesses 80, 81. Its shaft portion 22 is then engaged in the fingers 74 aligned with the recess 80 when segment 16 is brought back to vertical. The entire holder 12, with the segments 15, 16 clamped in place, can then be lifted and carried by the handle 58.

Those skilled in the art to which the invention relates will appreciate that other substitutions and modifications can be made to the described embodiment without departing from the spirit and scope of the invention as described by the claims below.

What is claimed is:

1. A golf practice device, comprising:

a flag;

a portable flagstaff adapted to support said flag at an upper end thereof, said staff including at least upper and lower vertically elongated staff segments; means for detachably connecting said upper and lower segments in coaxial alignment to form the vertical height of said flagstaff; a tapered main prong coaxially depending from a lower end of said lower segment; a tapered secondary prong depending from said lower end, in lateral spacing and parallel to said main prong; and a crosspiece extending generally horizontally between said prongs; said prongs being adapted for insertion into the ground, and said crosspiece being adapted to provide a foothold for assisting said insertion, and being further adapted to act with said prongs to limit the depth of insertion and to anchor said staff in the ground in a substantially upright position; and connecting means joining said flag to said upper end of said staff.

2. A device as in claim 1, wherein said flag comprises a plurality of grommets, and wherein said connecting means comprises a plurality of tubular sections having central bores coaxially received in vertically spaced positions about said upper segment, each section having a generally horizontally extending loop portion passing through a respective one of said grommets.

3. A device as in claim 2, wherein said tubular sections are freely rotatable about said upper segment, an uppermost one of said sections is fixed axially relative to said upper segment, said sections other than said one section are freely movable axially relative to said upper segment, and said connecting means further comprises said tubular sections being provided with side channels having vertically aligned secondary bores therethrough, and rod means passing through said secondary bores to limit the extent of rotation and amount of vertical spacing of said sections relative to one another.

4. A device as in claim 3, wherein said side channels are located within said loops.

5. A device as in claim 1, wherein said means for detachably connecting said segments comprises one of said upper and lower segments having a coaxial tip member with an externally threaded, coaxial shank part, and the other of said segments having an opposing, coaxial tip member with an internally threaded bore for interengaging with said shank member.

6. A device as in claim 5, wherein said prongs and crossmember are formed as an integral ground stake element attached to said lower end of said lower segment.

7. A device as in claim 6, wherein said segments are fiberglass rods and said tip members and ground stake element are metal.

8. A golf practice device, comprising:

upper and lower, generally horizontally extending bracket members, said lower member having an upper surface including a plurality of recesses;

bracing means attached between said bracket members for vertically spacing said members;

a portable flagstaff adapted to support a golf flag at an upper end thereof, said staff including at least upper and lower vertically elongated staff segments having shaft portions; means for detachably connecting said upper and lower segments in coaxial alignment to form the vertical height of said flagstaff; a tapered main prong coaxially depending from a lower end of said lower segment; a tapered secondary prong depending from said lower end, in lateral spacing and parallel to said main prong; and a crosspiece extending generally horizontally between said prongs; said prongs being adapted for insertion into the ground, and said crosspiece being adapted to provide a foothold for assisting said insertion, and being further adapted to act with said prongs to limit the depth of insertion and to anchor said staff in the ground in a substantially upright position;

a ball retriever adapted to capture and retain golf balls, said retriever including a vertically elongated hollow tube having a lower opening for receiving balls and an upper opening for discharging said balls, said hollow tube being positioned to depend below said lower bracket member; a container surrounding said tube at said upper opening and having an internal cavity to provide a repository for receiving and storing balls discharged from said tube; means for preventing escape of received balls from said lower opening; and a handle attached to said tube and located above said upper opening;

clamping means located on said upper bracket member for releasably receiving and securing said respective shaft portions of said unconnected upper and lower segments, with lower ends of said upper segment and prongs received in said recesses; and means fixing said handle to said upper bracket member to serve as a grip for said device.

9. A device as in claim 8, wherein said recesses comprise first, second and third recesses, said first and second recesses are laterally spaced by an amount, and said third recess are laterally spaced from said second recess by a distance equal to said lateral spacing of said prongs; and wherein said clamping means comprises first and second pairs of resiliently yieldable, opposing fingers; and said respective pairs are laterally spaced by the same amount as said lateral spacing distance between said first and second recesses;

10. A device as in claim 9, including a flag having a vertical dimension, and wherein said vertical spacing of said upper and lower bracket members is less than the vertical height of said connected segments by at least said vertical dimension of said flag, so that the clamped segments extend above the upper bracket member by at least a distance equal to a major portion of said vertical dimension of said flag.

11. A golf practice device comprising a flag assembly in combination with an apparatus serving as a holder for said flag assembly in cooperation with a ball retriever adapted to capture and retain golf balls, said retriever including a vertically elongated hollow tube having a lower opening for receiving balls and an upper opening for discharging said balls; a container surrounding said tube at said upper opening and having an internal cavity to provide a repository for receiving and storing balls discharged from said tube; means for preventing escape of received balls from said lower opening; and a handle attached to said tube and located above said upper opening; and wherein:

said flag assembly comprises a portable flagstaff adapted to support a golf flag at an upper end thereof, said staff including at least upper and lower vertically elongated staff segments having shaft portions; means for detachably connecting said upper and lower segments in coaxial alignment to form the vertical height of said flagstaff; a tapered main prong coaxially depending from a lower end of said lower segment; a tapered secondary prong depending from said lower end, in lateral spacing and parallel to said main prong; and a crosspiece extending generally horizontally between said prongs; said prongs being adapted for insertion into the ground, and said crosspiece being adapted to provide a foothold for assisting said insertion, and being further adapted to act with said prongs to limit the depth of insertion and to anchor said staff in the ground in a substantially upright position; and said apparatus comprising upper and lower, generally horizontally extending bracket members, said lower member having an upper surface including a plurality of recesses; bracing means attached between said bracket members for vertically spacing said members; clamping means located on said upper bracket member for releasably receiving and securing said respective shaft portions of said unconnected upper and lower segments, with lower ends of said upper segment and prongs received in said recesses; means for fixing said handle to said upper bracket member to serve as a grip for said holder; and means for fixing said tube to depend below said lower bracket member.

* * * * *